US008845017B1

(12) United States Patent
Lach

(10) Patent No.: US 8,845,017 B1
(45) Date of Patent: Sep. 30, 2014

(54) INSTRUMENT STAND WITH SEAT

(76) Inventor: Paul Peter Lach, Rancho Santa Margarita, CA (US)

( * ) Notice: Subject to any disclaimer, the term of this patent is extended or adjusted under 35 U.S.C. 154(b) by 290 days.

(21) Appl. No.: 13/307,203

(22) Filed: Nov. 30, 2011

Related U.S. Application Data

(60) Provisional application No. 61/417,958, filed on Nov. 30, 2010.

(51) Int. Cl.
*A47C 7/62* (2006.01)
*A47C 9/08* (2006.01)

(52) U.S. Cl.
USPC ..... 297/186; 297/461; 297/215.13

(58) Field of Classification Search
USPC ..... 297/186, 461, 195.11, 215.3, 313, 297/423.45, 423.46; 248/155, 150, 166, 248/439
See application file for complete search history.

(56) References Cited

U.S. PATENT DOCUMENTS

| | | | | | |
|---|---|---|---|---|---|
| 2,934,131 | A * | 4/1960 | Wenger | 297/186 |
| 3,014,760 | A * | 12/1961 | Gard | 297/188.08 |
| 4,793,654 | A * | 12/1988 | Takafuji | 297/338 |
| D355,773 | S | 2/1995 | MacOwan | |
| 5,505,413 | A * | 4/1996 | Hennessey | 248/166 |
| 5,957,417 | A * | 9/1999 | Yu | 248/166 |
| 6,462,260 | B2 * | 10/2002 | Fediakov | 84/327 |
| 6,540,182 | B1 * | 4/2003 | Wilfer | 248/121 |
| 6,585,315 | B1 | 7/2003 | Vail | |
| 6,877,706 | B2 * | 4/2005 | Harrison | 248/434 |
| 6,945,597 | B1 | 9/2005 | Brown | |
| 7,351,896 | B2 * | 4/2008 | Clifford | 84/327 |
| 7,717,377 | B1 * | 5/2010 | Corrado | 248/150 |
| 8,573,688 | B2 * | 11/2013 | Shackelford | 297/171 |
| 2003/0151277 | A1 * | 8/2003 | Chen | 297/195.11 |
| 2010/0096530 | A1 * | 4/2010 | Chiu | 248/439 |

* cited by examiner

*Primary Examiner* — David R Dunn
*Assistant Examiner* — Timothy J Brindley
(74) *Attorney, Agent, or Firm* — Eric Karich

(57) ABSTRACT

A combination instrument stand and seat has a support structure having at least one leg, and a seat pivotally mounted on the support structure with a seat pivot element to pivot between a horizontal position and a tilted position. A latch mechanism is adapted for locking the seat in the horizontal position. An instrument support extends from the support structure and is shaped to cradle a bottom of the instrument.

10 Claims, 6 Drawing Sheets

INSTRUMENT STAND WITH SEAT

CROSS-REFERENCE TO RELATED APPLICATIONS

This application for a utility patent claims the benefit of U.S. Provisional Application No. 61/417,958, filed Nov. 30, 2010.

STATEMENT REGARDING FEDERALLY SPONSORED RESEARCH

Not Applicable

BACKGROUND OF THE INVENTION

1. Field of the Invention

This invention relates generally to instrument stands and seats, and more particularly to a combination instrument stand and seat that may be used as a stand for an instrument, and then converted into a seat for a user to sit on while playing the instrument.

2. Description of Related Art

Instrument stands are know in the art, and a useful for holding an instrument when not being used. These stands not only store the instrument, they also serve to display the instrument, and to protect it somewhat from damage.

A seat is often positioned adjacent the stand so that the user can sit while playing the instrument. The disadvantage is that the seat takes up additional space in what might be an already crowded room.

The prior art teaches instrument stands. However, the prior art does not teach combination instrument stand and seat that includes the unique structures and features claimed herein. The present invention fulfills these needs and provides further related advantages as described in the following summary.

SUMMARY OF THE INVENTION

The present invention teaches certain benefits in construction and use which give rise to the objectives described below.

The present invention provides a combination instrument stand and seat that is adapted for supporting either a user in a seated position, or an instrument in a tilted position. The combination comprises a support structure having at least one leg; a seat pivotally mounted on the support structure with a seat pivot element to pivot between a horizontal position and a tilted position; a latch mechanism for locking the seat in the horizontal position; and an instrument support extending from the support structure, the instrument support being shaped to cradle a bottom of the instrument.

A primary objective of the present invention is to provide a combination instrument stand and seat having advantages not taught by the prior art.

Another objective is to provide a combination instrument stand and seat that may be used as a stand for an instrument, and then converted into a seat for a user to sit on while playing the instrument.

A further objective is to provide a combination that is efficient with space.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a combination instrument stand and seat 10 that may be used either as a stand for an instrument 12 or as a place to sit while playing the instrument 12.

Figure 1:
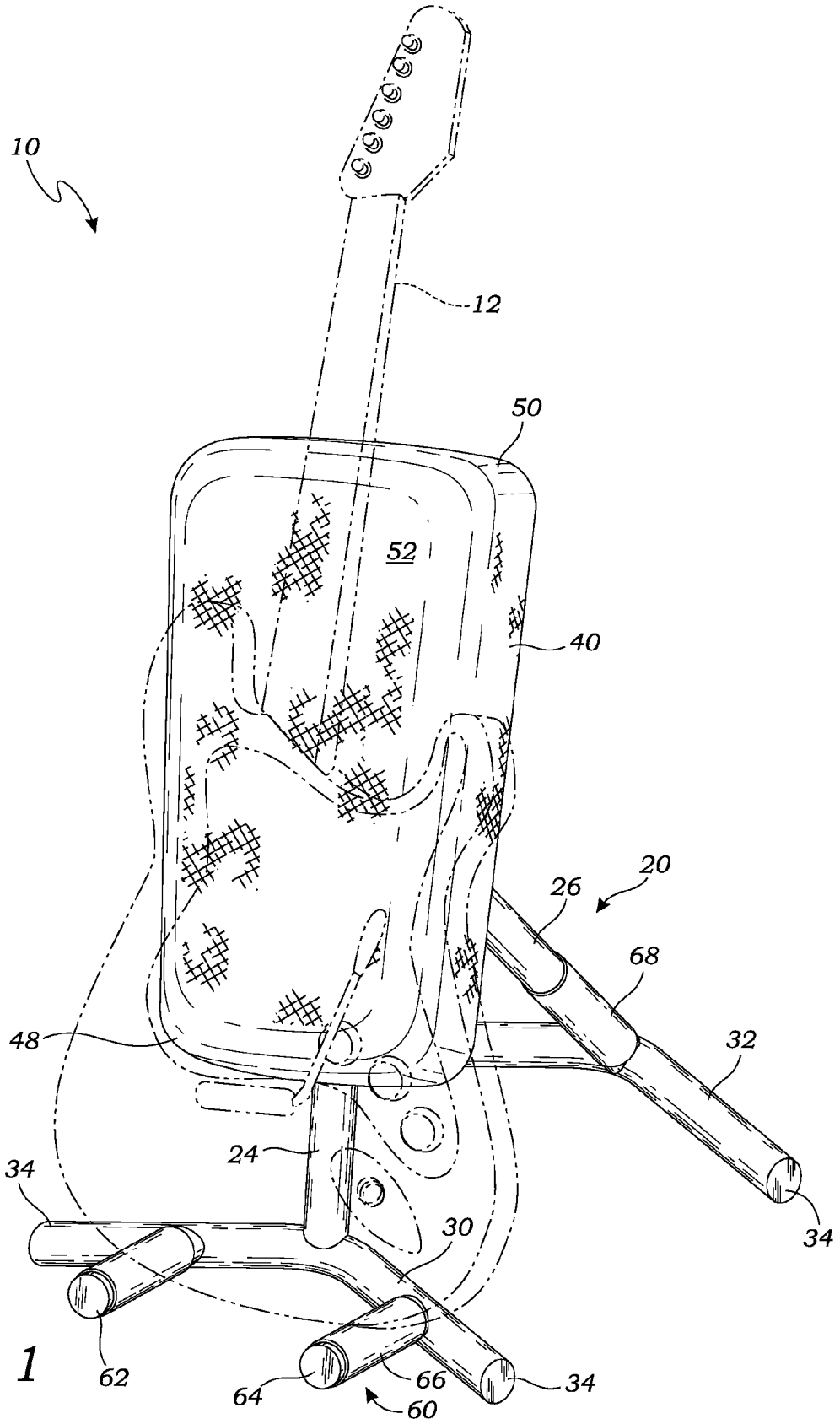
FIG. 1 is a perspective view of a instrument stand and seat according to one embodiment of the present invention, illustrating a support leg in an open position and a seat in an tilted position.
Figure 2:
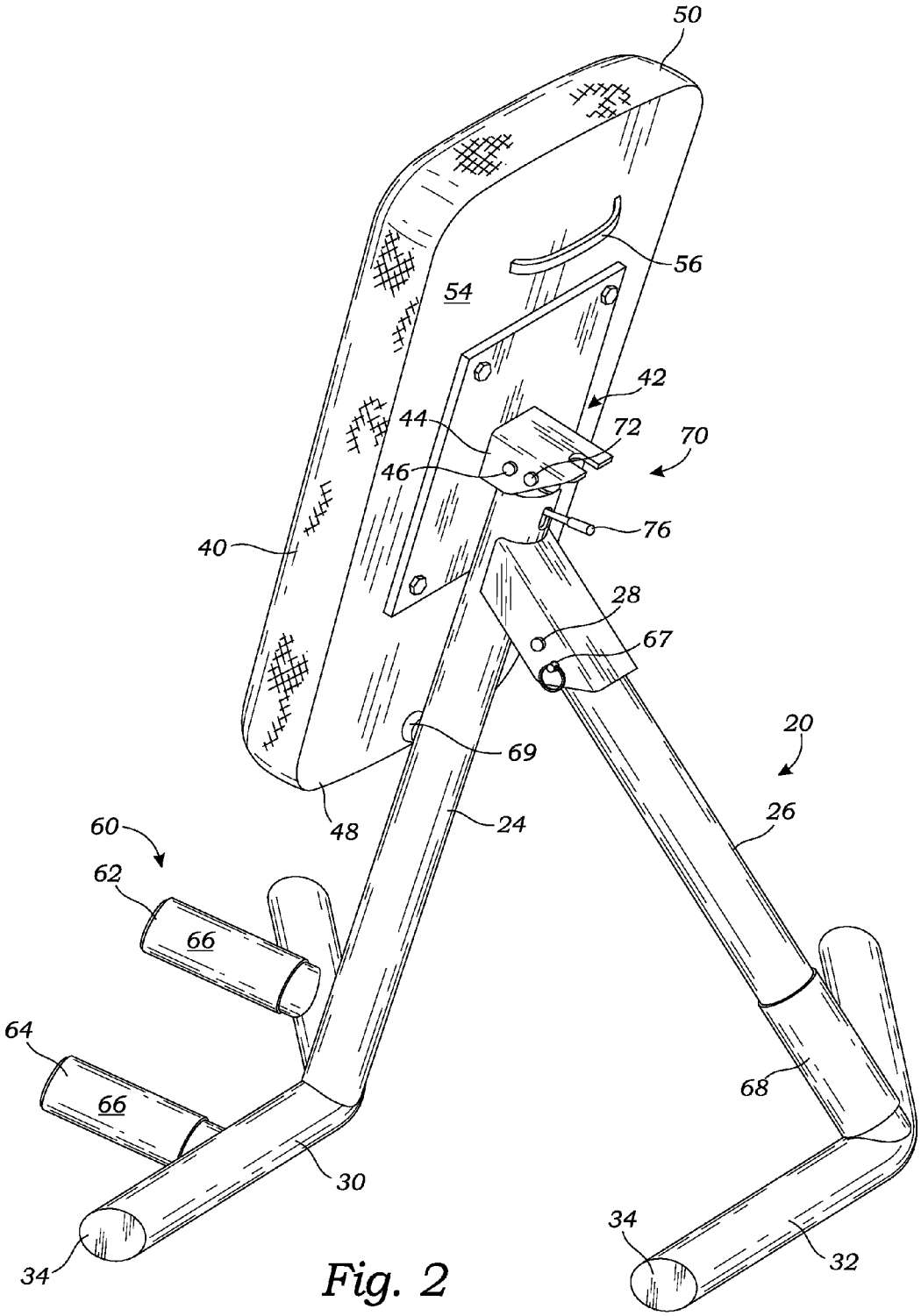
FIG. 2 is a rear perspective view thereof.

FIG. 1 is a perspective view of the combination 10 according to one embodiment of the present invention, illustrating a seat 40 in a tilted position for supporting the instrument 12. FIG. 2 is a rear perspective view thereof.

Figure 3:
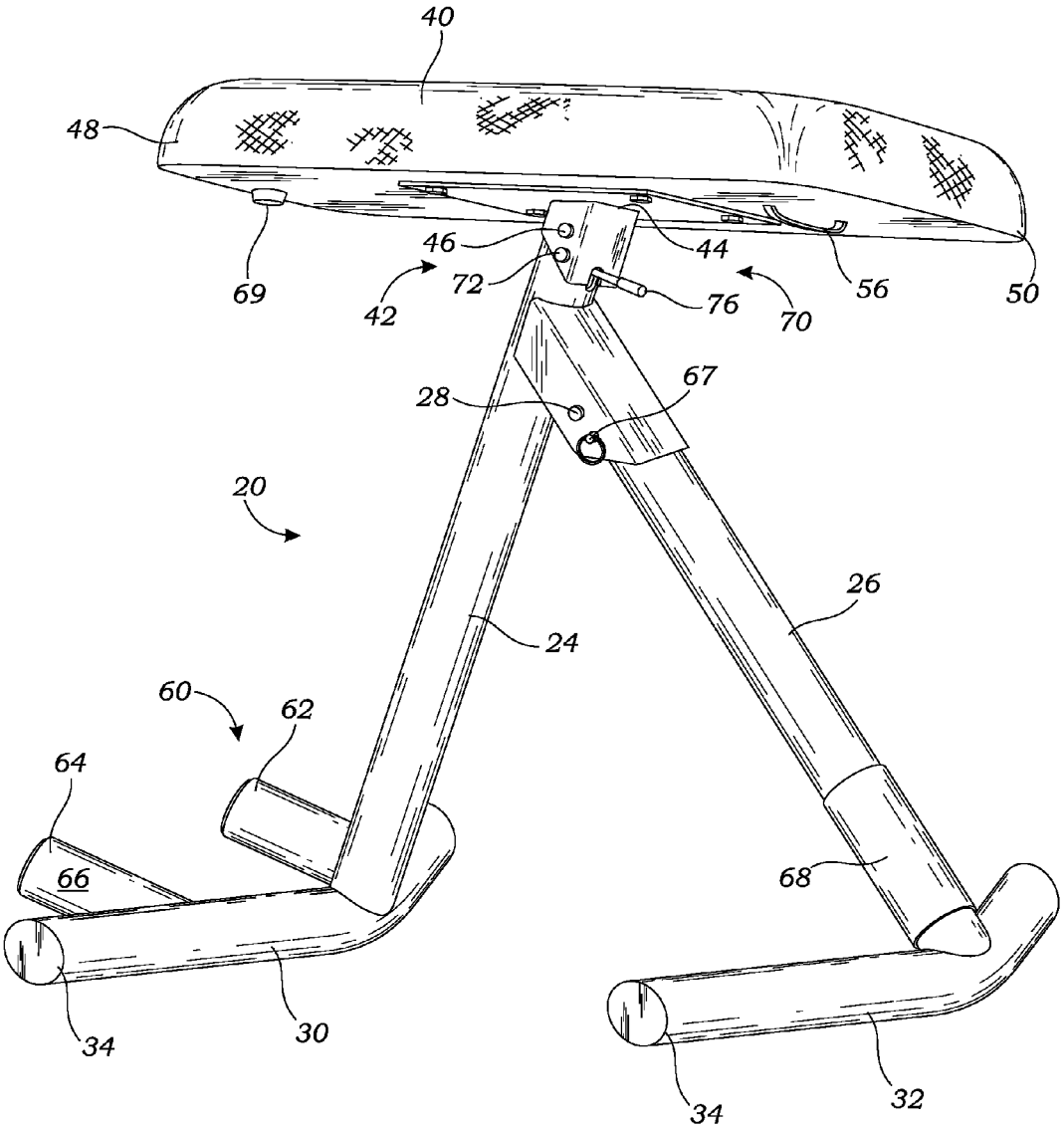
FIG. 3 is a perspective view of the instrument stand and seat, illustrating the support leg in the open position and the seat in a horizontal position.
Figure 4:
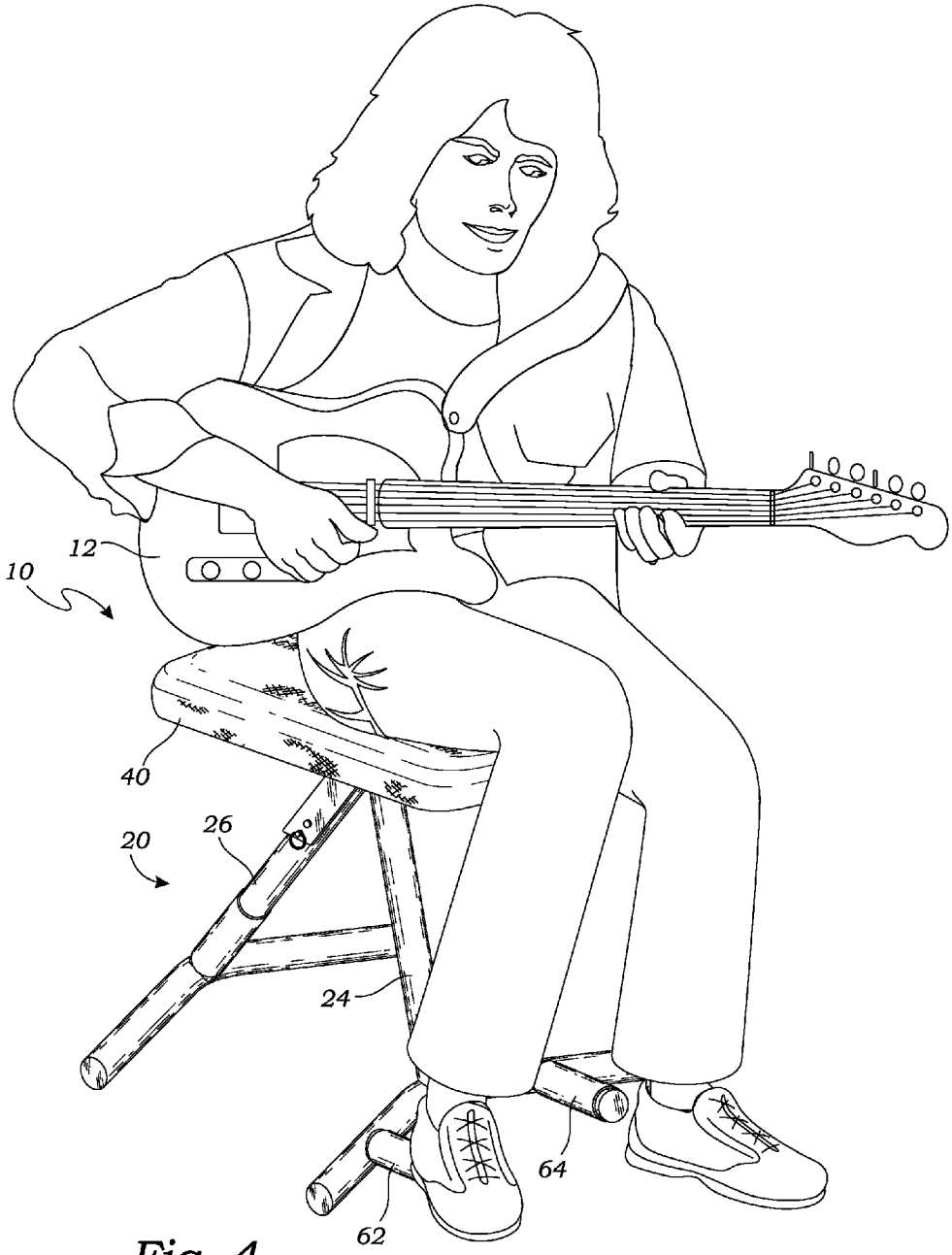
FIG. 4 is a perspective view of a user seated on the instrument stand and seat of FIG. 3.

FIG. 3 is a perspective view of the combination 10, illustrating the seat 40 in a horizontal position. FIG. 4 is a perspective view of a user seated on the combination 10 of FIG. 3. As illustrated in FIGS. 1-4, the combination 10 may also be readily changed from the tilted position that is suitable for supporting the instrument 12, to the horizontal position that is suitable for supporting the user in the seated position.

As illustrated in FIGS. 1-4, the combination 10 includes a support structure 20 having at least one leg for supporting the seat 40 above the ground with enough strength and stability to support the user or the instrument 12, as discussed in greater detail below. In the embodiment of FIGS. 1-4, the support structure 20 includes a first leg 24 and a second leg 26; however, any number of legs may be used in other embodiments of the invention. Further details of the construction of the support structure 20 are discussed in greater detail below, as are alternative embodiments.

In the present embodiment, the second leg 26 is pivotally connected to the first leg 24 with a leg pivot element 28, which is discussed in greater detail below. In this embodiment, the first leg 24 includes a first lateral support 30 and the second leg 26 includes a second lateral support 32. The first and second lateral supports 30 and 32 extend to feet 34 for supporting and stabilizing the combination. The feet 34 may include an anti-slipping element, such as foot pads (not shown) to prevent the feet 34 from slipping and/or to protect the floor. In an alternate embodiment, the feet 34 may include a protective coating, plastic, rubber, or the like. In this embodiment, both the first and second legs 24 and 26, and the lateral supports 30 and 32, are constructed of a tubular steel, although other materials and constructions may be used to provide a similar strong, rigid construction, as is known in the art.

The seat 40 may be pivotally mounted on the support structure 20 with a seat pivot element 42 to pivot between a tilted position (illustrated in FIGS. 1-2) and a horizontal position (illustrated in FIGS. 3-4). The seat 40 may include a seat mount 44 and a seat mount hinge 46. The seat mount 44 may be designed to provide a solid, secure mounting structure for the seat 40. The seat mount hinge 46 may be positioned between and in contact with the seat mount 44 and the support structure 20. The seat 40 may include a front portion 48 over the first leg 24, a rear portion 50 over the second leg 26, a top surface 52, and a bottom surface 54. The upper surface of the seat 40 may be at least partially covered in a non-slip, non-skid material to prevent movement of the instrument 12. The seat pivot element 42 may be, for example, a pivot bolt, although other forms of pivot or hinge may also be utilized.

In one embodiment, illustrated in FIG. 2, the seat 40 may include a carrying strap 56 attached at each end to the bottom surface 54 of the seat 40 on or adjacent the rear portion 50. The strap forms a handle that enables the combination 10 to be easily carried.

Also illustrated in FIGS. 1-4, the combination 10 further includes an instrument support 60 extending from the support structure 20 shaped to cradle a bottom of the instrument 12. In the embodiment of FIGS. 1-4, the instrument support 60 may include first and second outwardly extending posts 62 and 64 extending from the first lateral support 30 away from the second leg 26. The first and second outwardly extending posts 62 and 64 may include an outer resilient layer 66 around each of the outwardly extending posts 62 and 64 for cushioning the instrument 12 as it rests on the instrument support 60.

Figure 5:
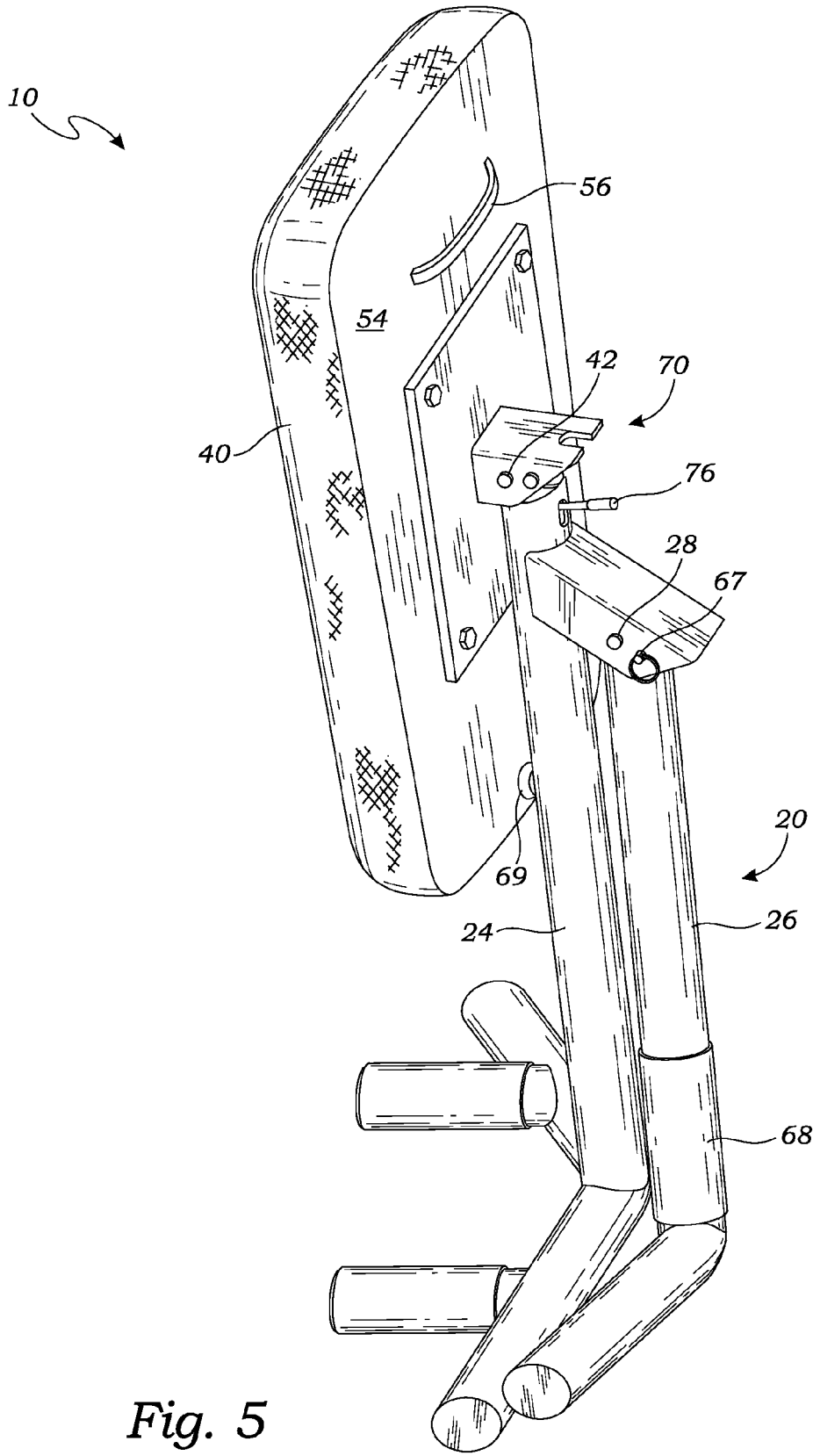
FIG. 5 is a rear perspective view of the instrument stand and seat, illustrating the support leg in a closed position.

FIG. 5 is a rear perspective view of the combination instrument stand and seat 10, illustrating the first and second legs 24 and 26 in a closed position suitable for transportation or storage. As illustrated in FIGS. 2 and 5, in this embodiment, the first leg 24 is pivotally connected to the second leg 26 with the leg pivot element 28 to pivot between an open position, illustrated in FIG. 2, and a closed position, illustrated in FIG. 5. In this embodiment, the leg pivot element 28 includes a pivot bolt; however, other forms of pivot elements and/or hinges may also be used, and should be considered within the scope of the present invention.

The leg pivot element 28 may further include a leg mount hinge pin 67 for fixing the first and second legs 24 and 26 in the open and/or closed position. While a leg mount hinge pin 67 is shown in the present embodiment, in alternative embodiments the mechanism may be a locking button (not shown), or other similar mechanism known in the art for adjusting the position of the second leg 26 with respect to the first leg 24. In an alternative embodiment, a cable, a chain, a hinge or some other mechanism may also be positioned between the legs to provide stability.

Also illustrated in FIG. 5, the combination may further include a leg cushioning element 68 operably mounted on the support structure 20 for preventing the first and second legs 24 and 26 from directly abutting each other in the closed position. In this embodiment, the leg cushioning element 68 is a resilient band (e.g., rubber, plastic, etc.) around one or both of the legs. The leg cushioning element 68 cushions the legs so that they do not bang together in an unpleasant and/or damaging manner.

Similarly, the seat 40 may include a seat cushioning element 69 that extends from the bottom surface 54 of the seat 40 to abut the support structure 20 when the seat 40 is in the tilted position. The seat cushioning element 69 may also be made of a resilient material (e.g., rubber, plastic, etc.) to prevent the seat 40 from banging against the support structure 20 in an unpleasant and/or damaging manner.

Figure 6:
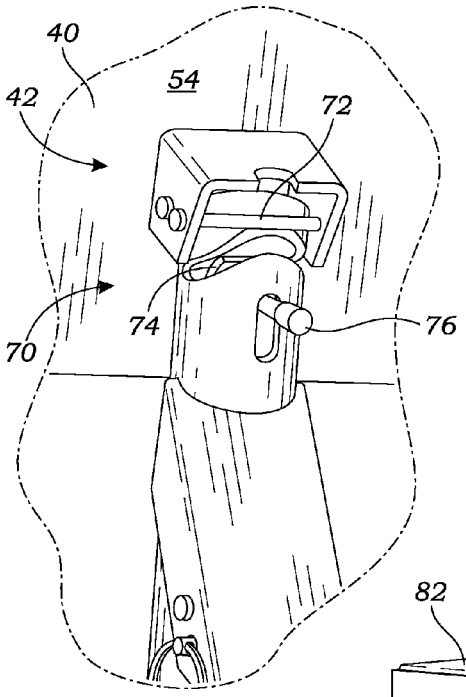
FIG. 6 is a close up view of a latch mechanism of FIG. 2.

FIG. 6 is a close up view of a latch mechanism 70 of FIG. 2. The latch mechanism 70 is adapted for locking the seat 40 in the horizontal position. In the embodiment of FIG. 6, the latch mechanism 70 includes a locking bolt 72 attached to a bracket of the seat 40. The latch mechanism 70 may further include a latch element 74 movably mounted within the support structure 20 to move to interlock with the locking bolt 72. A lever 76 may extend from the latch element 74 for controlling the movement of the latch element 74 to either engage or disengage the locking bolt 72. While one embodiment of the latch mechanism 70 is illustrated, those skilled in the art may devise alternative embodiments that interlock or otherwise position the seat 40 as desired, and such alternatives are hereby defined to be expressly considered within the scope of the term "locking mechanism."

Figure 7:
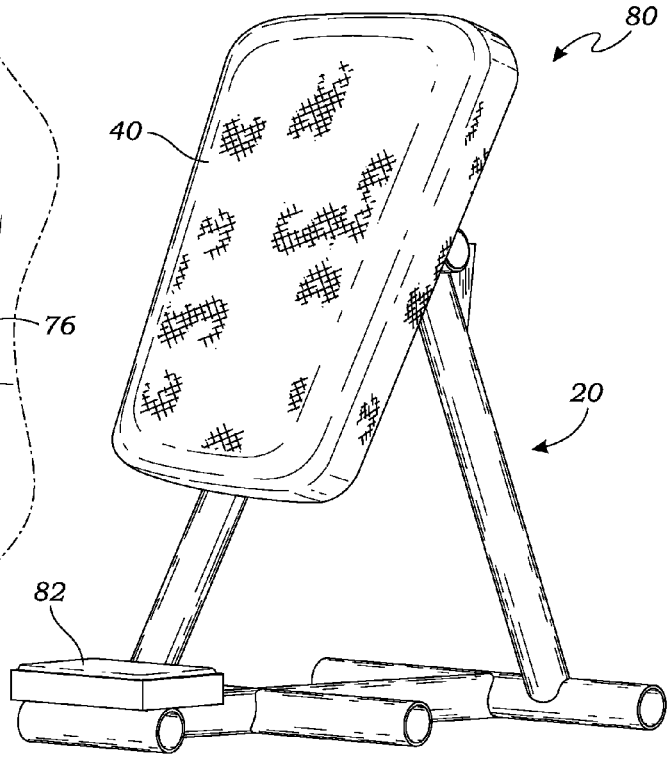
FIG. 7 is a perspective view of a second embodiment of the instrument stand and seat, illustrating the seat in an tilted position.
Figure 8:
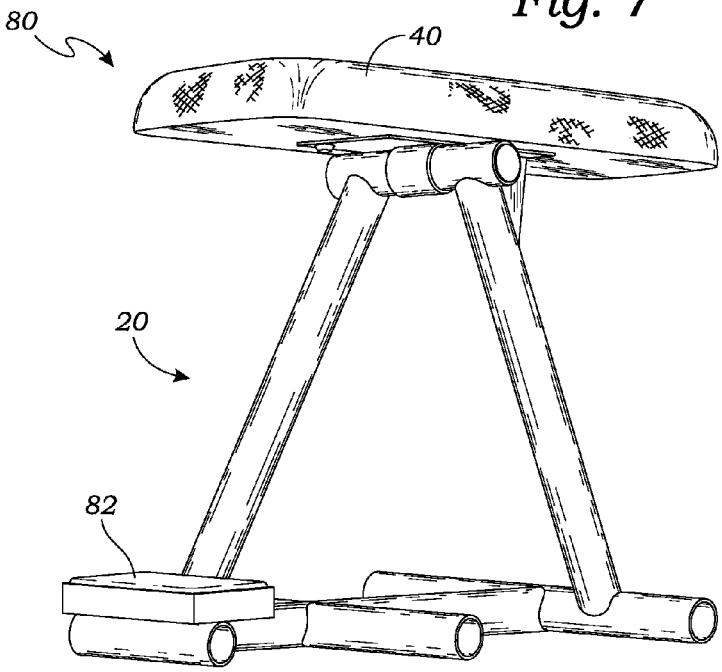
FIG. 8 is a perspective view of the instrument stand and seat of FIG. 7, illustrating the seat is a horizontal position.

FIG. 7 is a perspective view of a second embodiment 80 of the instrument stand and seat 40, illustrating the seat 40 in an tilted position. FIG. 8 is a perspective view of the instrument stand and seat 40 of FIG. 7, illustrating the seat 40 is a horizontal position. As illustrated in FIGS. 7-8, the support structure 20 can vary greatly in construction. While the illustrated construction illustrates one alternative construction, it should be understood that those skilled in the art may devise many alternative constructions, and these alternatives should be considered within the scope of the present invention. Also illustrated is another embodiment of the instrument support, which in this embodiment is a single padded structure 82, although any other form of support that functions to support the instrument 12 may also be used.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A combination instrument stand and seat, the combination being adapted for supporting either a user in a seated position, or an instrument in a tilted position, the combination comprising:

a support structure having a first leg and a second leg, the first leg being pivotally connected to the second leg with a leg pivot element to pivot between an open position and a closed position;

a seat that includes a top surface and a bottom surface that provide a front portion and a rear portion;

a seat mount extending downwardly from the bottom surface of the seat, the seat mount being pivotally mounted on the first leg with a seat mount hinge that includes a bolt that extends through the seat mount and the support structure so that the seat may pivot about the bolt between a horizontal position and a tilted position;

a latch mechanism mounted on the support structure for locking the seat in the horizontal position; and an instrument support extending from the support structure, the instrument support being shaped to cradle a bottom of the instrument, such that, while the second leg remains in the open position, the seat may pivot between the horizontal position for supporting the user in a seated position, or the tilted position for supporting the instrument;

wherein the first leg includes a first lateral support that extends laterally on either side of the first leg, and wherein the second leg includes a second lateral support that extends laterally on either side of the second leg, so that the first and second legs are supported on the first and second lateral supports, respectively, to support the combination in an upright orientation;

wherein the instrument support includes first and second outwardly extending posts extending from the first lateral support away from the second leg.

2. The combination of claim 1, wherein the first leg includes a first lateral support that extends laterally on either side of the first leg, and wherein the second leg includes a second lateral support that extends laterally on either side of the second leg, so that the first and second legs are supported on the first and second lateral supports, respectively, to support the combination in an upright orientation.

3. The combination of claim 2, wherein the instrument support includes first and second outwardly extending posts extending from the first lateral support away from the second leg.

4. A combination instrument stand and seat, the combination being adapted for supporting either a user in a seated position, or an instrument in a tilted position, the combination comprising:

a support structure having a first leg and a second leg, the first leg being pivotally connected to the second leg with a leg pivot element to pivot between an open position and a closed position, wherein the first leg includes a first lateral support and wherein the second leg includes a second lateral support;

a seat that includes a top surface and a bottom surface that provide a front portion and a rear portion;

a seat mount extending downwardly from the bottom surface of the seat, the seat mount being pivotally mounted on the first leg with a seat mount hinge that includes a bolt that extends through the seat mount and the support structure so that the seat may pivot about the bolt between a horizontal position and a tilted position;

a latch mechanism mounted on the support structure for locking the seat in the horizontal position; and an instrument support extending from the support structure, the instrument support being shaped to cradle a bottom of the instrument, wherein instrument support includes first and second outwardly extending posts extending from the first lateral support away from the second leg.

5. The combination of claim 4, wherein the latch mechanism is mounted on the support structure for locking with a locking bolt that extends through the seat mount adjacent the bolt of the seat mount hinge, the latch mechanism functioning to lock the seat in the horizontal position.

6. The combination of claim 4, further comprising a carrying strap attached at each end to the bottom surface of the seat on the rear portion, such that when the seat is pivoted to the tilted position, the carrying strap enables the combination to be easily carried by the carrying strap.

7. The combination of claim 4, further comprising an outer resilient layer around each of the outwardly extending posts.

8. The combination of claim 4, further comprising a leg mounting pin that extends through the second leg to fix the position of the second leg with respect to the first leg.

9. The combination of claim 4, further comprising a resilient band around the first leg or the second leg shaped to prevent the first leg and the second leg from contacting each other when moved to the closed position.

10. The combination of claim 4, further comprising:

a lever extending from the latch mechanism; and a locking bolt attached to the seat, wherein the lever operably controls the movement of the latch mechanism to either engage or disengage the locking bolt.

* * * * *